US008851056B2

(12) United States Patent
Trpkovski

(10) Patent No.: US 8,851,056 B2
(45) Date of Patent: Oct. 7, 2014

(54) DUAL INVERTED LIMB

(75) Inventor: Paul Trpkovski, Green Cove Springs, FL (US)

(73) Assignee: MCP IP, LLC, Sparta, WI (US)

( * ) Notice: Subject to any disclaimer, the term of this patent is extended or adjusted under 35 U.S.C. 154(b) by 157 days.

(21) Appl. No.: 13/481,525

(22) Filed: May 25, 2012

(65) Prior Publication Data

US 2013/0042848 A1 Feb. 21, 2013

Related U.S. Application Data

(60) Provisional application No. 61/489,736, filed on May 25, 2011.

(51) Int. Cl.

| | |
|---|---|
| ***F41B 5/00*** | (2006.01) |
| ***F41B 5/12*** | (2006.01) |
| ***F41B 5/14*** | (2006.01) |
| ***F41B 5/10*** | (2006.01) |

(52) U.S. Cl.

CPC . *F41B 5/123* (2013.01); *F41B 5/10* (2013.01); *F41B 5/0052* (2013.01)

USPC ..... 124/23.1; 124/25; 124/25.6; 124/86

(58) Field of Classification Search

CPC ..... F41B 5/0052; F41B 5/10; F41B 5/12; F41B 5/123

USPC ..... 124/23.1, 25, 25.6, 86

See application file for complete search history.

(56) References Cited

U.S. PATENT DOCUMENTS

| | | | | | |
|---|---|---|---|---|---|
| 2,100,317 | A | * | 11/1937 | Hickman | 124/23.1 |
| 2,500,509 | A | * | 3/1950 | Bailey | 124/25 |
| 2,714,377 | A | * | 8/1955 | Mulkey | 124/23.1 |
| 2,894,503 | A | * | 7/1959 | Pierson et al. | 124/23.1 |
| 2,957,470 | A | * | 10/1960 | Barna | 124/23.1 |
| 3,502,063 | A | * | 3/1970 | Bear | 124/23.1 |
| 3,809,048 | A | * | 5/1974 | Handford | 124/25 |
| 3,812,835 | A | * | 5/1974 | Smith | 124/25.6 |
| D237,490 | S | * | 11/1975 | McArdle | D22/107 |
| D237,491 | S | * | 11/1975 | McArdle | D22/107 |

(Continued)

OTHER PUBLICATIONS

Classic-bow.com, Traditional, recurve bows, Bow Shop, Handmade Traditional Hungarian Mongolian Schytian recurve.

*Primary Examiner* — Gene Kim

*Assistant Examiner* — Alexander Niconovich

(74) *Attorney, Agent, or Firm* — Vidas, Arrett & Steinkraus

(57) ABSTRACT

A bow is adapted to shoot a projectile along a direction of flight. The bow includes a riser, a first limb, a second limb, and a drawstring. The riser extends perpendicular to the direction of flight. The riser includes a first mount adjacent a first end and a second mount adjacent a second end of the riser. The first and the second limbs extend along first and second contours from a proximal end to a distal end. The first limb is mounted to the first mount of the riser. The first contour includes a first attachment segment positioned adjacent the first mount. The second limb is mounted to the second mount of the riser. The second contour includes a second attachment segment positioned adjacent the second mount. The drawstring is operably connected to the first and the second limbs adjacent the distal ends. The first and the second attachment segments at least partially extend in the direction of flight from the proximal end to the distal end of the corresponding attachment segment.

27 Claims, 12 Drawing Sheets

(56) References Cited

U.S. PATENT DOCUMENTS

| | | | | | |
|---|---|---|---|---|---|
| 3,965,883 | A * | 6/1976 | Meyer | 124/23.1 |
| 4,018,205 | A * | 4/1977 | Meyer | 124/23.1 |
| 4,178,904 | A * | 12/1979 | Meininger | 124/23.1 |
| 4,183,345 | A * | 1/1980 | Caldwell | 124/25.6 |
| 4,227,509 | A * | 10/1980 | Jones | 124/25.6 |
| 4,545,358 | A * | 10/1985 | Collins | 124/88 |
| 4,649,891 | A * | 3/1987 | Bozek | 124/25 |
| 4,722,317 | A * | 2/1988 | Hartwig | 124/25.6 |
| 4,766,874 | A * | 8/1988 | Nishioka | 124/25 |
| 4,926,834 | A * | 5/1990 | Chauvin | 124/25 |
| 4,989,577 | A * | 2/1991 | Bixby | 124/25.6 |
| 5,024,206 | A * | 6/1991 | Lester | 124/23.1 |
| 5,172,679 | A * | 12/1992 | Mussack | 124/25.6 |
| 5,454,361 | A * | 10/1995 | Bronnert | 124/23.1 |
| 5,522,373 | A * | 6/1996 | Barnett | 124/25 |
| 5,630,405 | A * | 5/1997 | Nizov | 124/25 |
| 5,651,354 | A * | 7/1997 | La Haise, Sr. | 124/23.1 |
| 5,706,794 | A * | 1/1998 | Neal | 124/25.6 |
| 5,720,268 | A * | 2/1998 | Koltze | 124/25 |
| 5,901,692 | A * | 5/1999 | Allshouse et al. | 124/23.1 |
| 5,921,227 | A * | 7/1999 | Allshouse et al. | 124/25.6 |
| 6,029,644 | A * | 2/2000 | Bronnert | 124/25.6 |
| 6,367,464 | B1 * | 4/2002 | Bronnert | 124/23.1 |
| 6,901,921 | B1 | 6/2005 | Barnett | |
| 6,990,970 | B1 * | 1/2006 | Darlington | 124/25.6 |
| 7,204,242 | B2 * | 4/2007 | Dziekan | 124/25 |
| 7,328,693 | B2 * | 2/2008 | Kempf | 124/25 |
| 7,743,760 | B2 * | 6/2010 | Woodland | 124/25.6 |
| 7,836,871 | B2 * | 11/2010 | Kempf | 124/25 |
| 7,891,349 | B1 | 2/2011 | Kronengold et al. | |
| 7,938,108 | B2 * | 5/2011 | Popov et al. | 124/25 |
| 8,104,461 | B2 * | 1/2012 | Kempf | 124/25 |
| 8,191,541 | B2 * | 6/2012 | Shaffer et al. | 124/25 |
| 8,347,869 | B2 * | 1/2013 | Sims et al. | 124/23.1 |
| 8,522,762 | B2 * | 9/2013 | Trpkovski | 124/25.6 |
| 2005/0279338 | A1 * | 12/2005 | Dziekan | 124/25 |
| 2011/0030666 | A1 * | 2/2011 | Darlington | 124/25 |
| 2011/0041820 | A1 * | 2/2011 | Stanziale | 124/25 |
| 2013/0061836 | A1 * | 3/2013 | Kempf | 124/25 |

* cited by examiner 96A
192A
194
DS
190
96B
154A
154B
91B
92A
124
150A, 650A
150B, 650B
192B
92
120A, 620A
DF
110, 610
120B, 620B
92B
100, 600
96
700

192A
DS
194
190
92
192B
120A, 620A
120B, 620B
150A
150B
110, 610
DF
124
96

DUAL INVERTED LIMB

CROSS REFERENCE TO RELATED APPLICATION

This application claims priority to U.S. Provisional Patent Application Ser. No. 61/489,736, filed on May 25, 2011, titled DUAL INVERTED LIMB, which is hereby incorporated by reference in its entirety.

BACKGROUND

Archery bows have been in existence in many forms for thousands of years. Many ancient civilizations had variety of shaped bows that gave the bow unique features and more power. In recent years, crossbows, compound bows, and recurve bows have also had many improvements to increase power, improve accuracy, decrease overall size and weight, and decrease the shock that the weapon produces during and after the shot. The shape of the limbs can have a significant impact on the displaced energy.

SUMMARY

In general terms, this disclosure is directed to a dual inverted limb for a bow. In one possible configuration and by non-limiting example, the dual inverted limb includes a pair of limbs where each limb extends from a central riser in the forward direction away from the shooter and has a limb tip that ends on the opposite side of the riser near the shooter.

According to certain aspects of the present disclosure, a bow is adapted to shoot a projectile along a direction of flight. The bow includes a riser, a first limb, a second limb, and a drawstring. The riser extends between a first end and a second end in a direction generally perpendicular to the direction of flight. The riser includes a first side and a second side that each extend between the first and the second ends of the riser. The first side of the riser is spaced from the second side of the riser along the direction of flight. The riser includes a first mount that is adjacent the first end of the riser and a second mount that is adjacent the second end of the riser. The first limb extends along a first contour from a proximal end to a distal end. The first limb is mounted to the first mount of the riser adjacent the proximal end of the first limb. The first contour includes a first attachment segment that extends from a proximal end to a distal end. The first attachment segment is positioned adjacent the first mount. The second limb extends along a second contour from a proximal end to a distal end. The second limb is mounted to the second mount of the riser adjacent the proximal end of the second limb. The second contour includes a second attachment segment that extends from a proximal end to a distal end. The second attachment segment is positioned adjacent the second mount. The drawstring is operably connected to the first and the second limbs adjacent the distal ends of the first and the second limbs. The first and the second attachment segments at least partially extend in the direction of flight from the proximal end to the distal end of the corresponding attachment segment.

DESCRIPTION OF THE DRAWINGS

FIG. 1 illustrates a recurve crossbow;

FIG. 4 illustrates a recurve bow;

FIG. 6 illustrates a compound crossbow;

FIG. 8 illustrates a compound bow;

FIG. 10 illustrates a compound bow in a drawn configuration;

DETAILED DESCRIPTION

Figure 1:
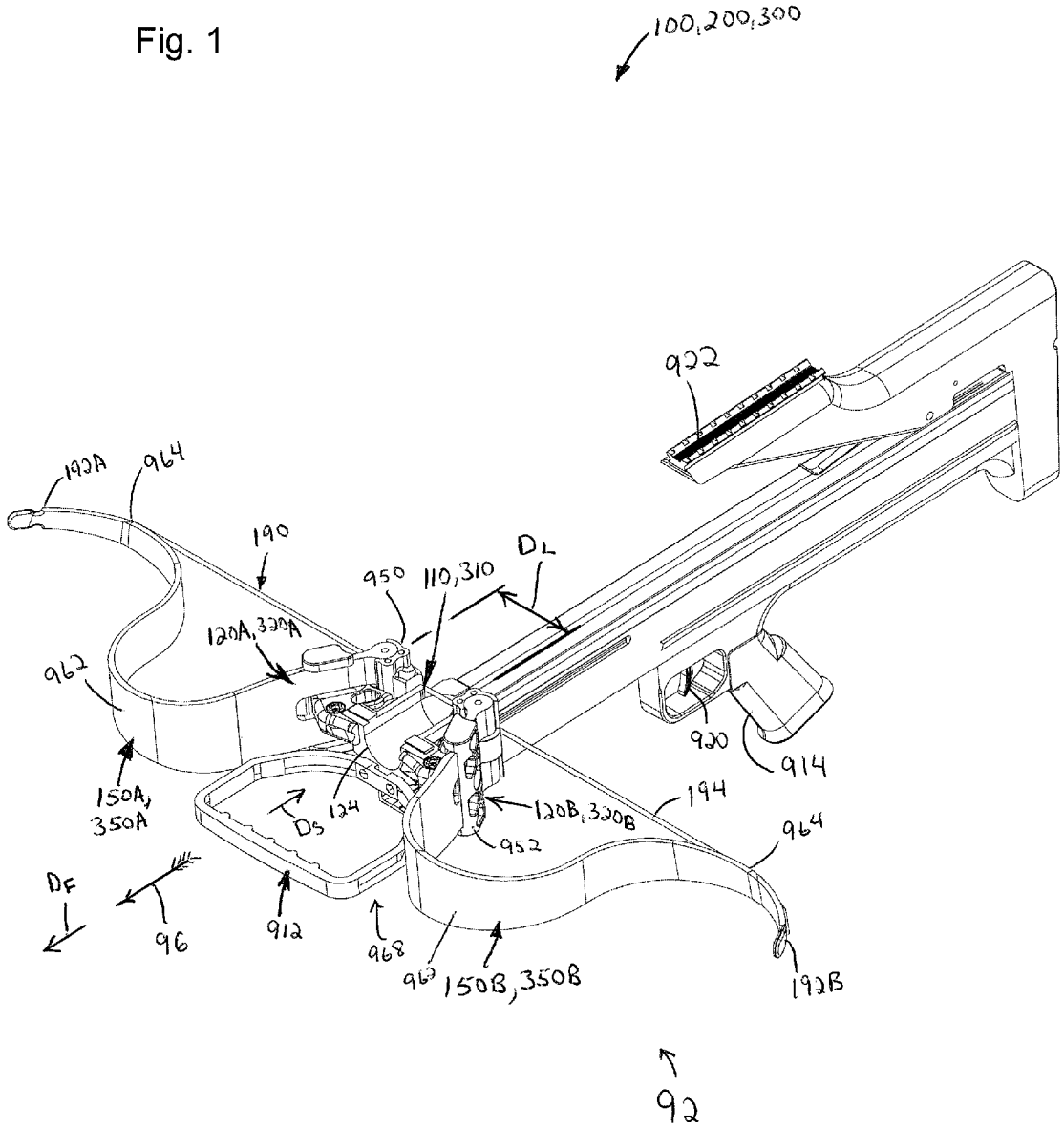
FIG. 1 is a perspective view of a bow according to the principles of the present disclosure, in particular

Various embodiments will be described in detail with reference to the drawings, wherein like reference numerals represent like parts and assemblies throughout the several views. Reference to various embodiments does not limit the scope of the claims attached hereto. Additionally, any examples set forth in this specification are not intended to be limiting and merely set forth some of the many possible embodiments for the appended claims.

Today, most crossbow manufacturers are making crossbows with almost parallel limbs to reduce recoil, but are also faced with reducing powerstroke in accomplishing the task. Furthermore, they are increasing the size and width of the riser to position the limbs to get them in position to be mounted near parallel. Essentially, getting the limbs to this position reduces powerstroke and increases the weight of the crossbow which are both negative aspects. Finally, crossbow manufacturers have been designing the foot stirrup into the riser to take advantage of the extra space provided by the larger riser.

Most compound bow manufacturers are designing bows to reduce felt hand shock and recoil. The most common method is to get the limbs either flexed or positioned to be in a near parallel position. In doing so, the riser for the bow becomes much longer and deeper and adds weight to the overall bow. Furthermore, manufacturers are attempting to minimize limbs movement to keep the limbs on center, shot after shot. The limb designs do not pivot left/right about their neutral axis, thus causing the string to move with the slightest movement in the limb pocket tensioning system.

Modern recurve bows do not attempt to cancel recoil from the shot. Modern recurves need the limbs pointing in the near vertical direction to get enough draw length from the flexing of the limbs tips, and therefore they are very long (e.g., 38" or more) with long slightly curved limbs to get sufficient limb tip flex to obtain the draw length.

According to the principles of the present disclosure, limb, riser, and limb tensioning systems, referred to herein as Dual Inverted Limb Systems, include configurations that provide various advantages over prior art bows using prior art limb and riser systems. The Dual Inverted Limb Systems disclosed herein can be used to make compound bows, crossbows, recurve bows, compound crossbows, and/or recurve crossbows to reduce felt hand shot recoil, improve compactness, improved energy density, and/or improve accuracy. Furthermore, the Dual Inverted Limb Systems preserve powerstroke in compound crossbows by starting the limbs in a forward direction, thereby moving cams of the compound crossbow forward. Also, the Dual Inverted Limb Systems reduce the riser size and/or weight for all types of crossbows and bows by allowing lightweight composite limbs (e.g., carbon fiber based composites, glass fiber based composites, etc.) to make up more of the bow. The Dual Inverted Limb Systems may include one or more of the following features: 1) parallel limbs or parallel limb portions; 2) reduced riser size; 3) limb contour paths continuing forward from riser mount, reversing direction, and ending reward at limb tip; 4) limb tension system that may include a pivot, a tension bolt, and a clamp and may be adjustable; 5) limbs that rotate about a neutral axis to maintain string alignment; and, 6) limbs with sweeping shape that extends a contour length of the limb for increases flex. Any one of the aforementioned items provide new improvements over prior art technologies, and, alone or combined, produce improvements to prior art bows. By combining certain of these items, a crossbow, compound bow, recurve bow, compound crossbow, and/or recurve crossbows can be produced that is shorter, lighter, more accurate, and/or lower cost. Certain embodiments provide a method of producing a recurve bow with limb portions that are near perpendicular with the riser to reduce recoil hand shock.

1—Parallel Limbs

Figure 11:
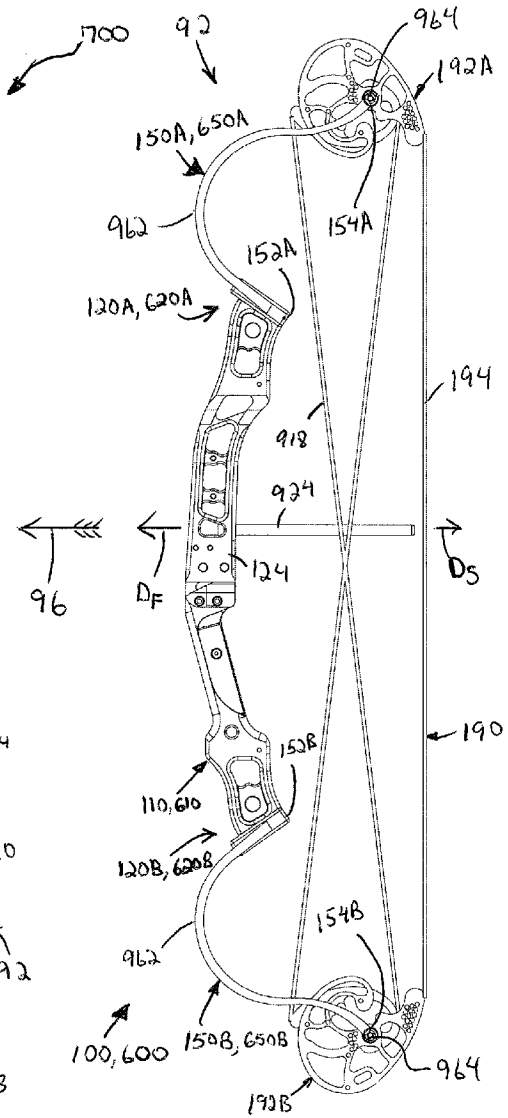
FIG. 11 is a left side elevation view of the bow of FIG. 10, the bow illustrated in an undrawn configuration.
Figure 12:
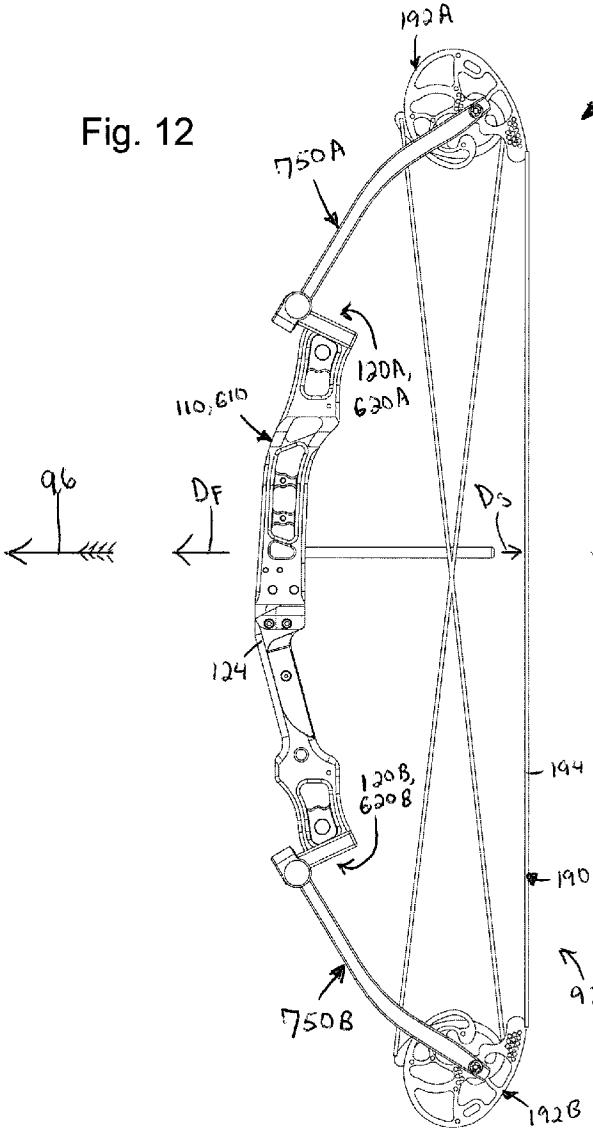
FIG. 12 is a left side elevation view of a bow including a riser of the bow of FIG. 10.

A bow 600 of FIG. 11 includes limbs 650A, 650B according to the principles of the present disclosure. In contrast, a bow 700 of FIG. 12 includes prior art limbs 750A, 750B. The limbs 650A, 650B have a unique sweeping pattern/contour that starts the limbs 650A, 650B at a proximal end 152A, 152B from a riser 610 in a forward direction but end the limbs 650A, 650B rearward of the starting point at a distal end 154A, 154B. This unique sweep/contour allows the limbs 650A, 650B to end with a tip adjacent the distal end 154A, 154B of the limbs 650A, 650B either parallel, near parallel, or past parallel and thereby cancel all recoil felt or to thereby cancel a substantial portion of the recoil otherwise felt. Furthermore, the limbs can be a single cantelevered limb or a set of split limbs to accomplish the task. Also, the limbs 650A, 650B can have various shapes/contours from that which is shown as long as the limbs 650A, 650B start in the forward direction and end behind the starting point. This allows the limb design and shape/contour to adjust braceheight, powerstroke, and riser size.

Figure 10:
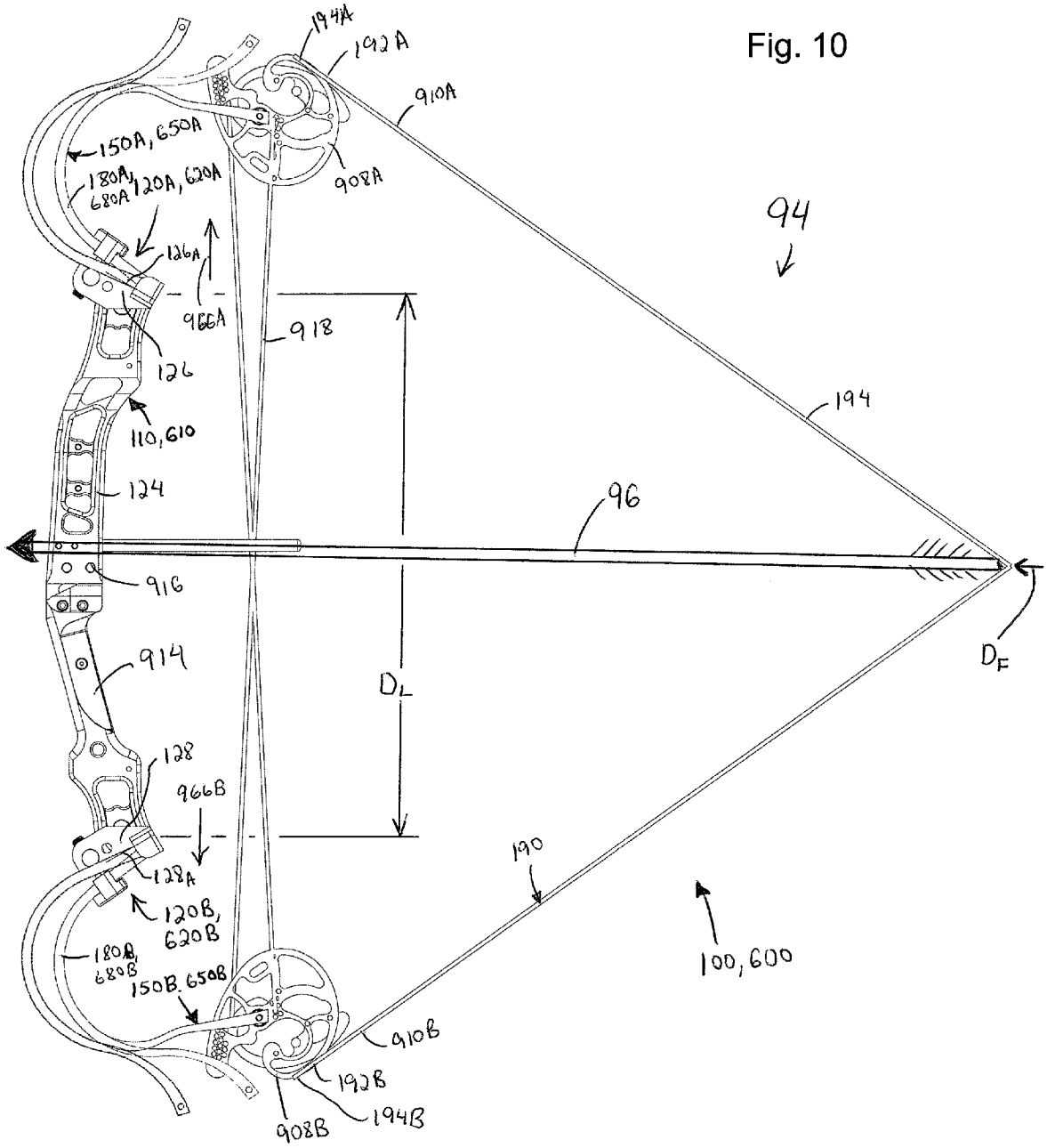
FIG. 10 is a left side elevation view of a bow according to the principles of the present disclosure, in particular

As illustrated at FIG. 10, the corresponding contours of the first and the second limbs 650A, 650B are shaped such that at least a portion of movement 966A of the first limb 650A is opposite at least a portion of movement 966B of the second limb 650B when the first and the second limbs 650A, 650B move from a drawn configuration 94 to an undrawn configuration 92. The movements 966A, 966B of the first and the second limbs 650A, 650B thereby at least partially cancel recoil.

2—Reduced Riser Size

The Dual Inverted Limb Systems technology allows the riser (e.g., the riser 610) to be minimized to the grip and sight window and the limbs (e.g., the limbs 650A, 650B) shaped to position the limb tips to meet the braceheight, axle-to-axle spacing, and overall size of the bow for crossbows, compound bows, recurve bows, compound crossbows, and/or recurve crossbows thereby reducing cost and weight.

3—Limb Forward—Rearward Design

In considering details of the swept shape/contour of the limbs 650A, 650B, instead of the limbs starting in a rearward direction, towards the shooter, and staying in that direction, the Dual Inverted Limb Systems technology uses limbs that are either laminated to shape, cast to shape, or molded to shape. The limbs 650A, 650B are then preloaded about 2" to 4" from the relaxed state to preload a draw string 194. The limb design allows for increased limb length in a very compact space by the sweeping shape/contour. More specifically, the limbs 650A, 650B are strategically started in the forward direction and then swept back in at about a 1" to 10" radius to position the limb tip in the ideal location. The limbs 650A, 650B can also have additional sweeps in other directions to increase preloading of the limbs 650A, 650B, but preferably end rearward of the starting point.

4—Unique Limb Tensioning System

The Dual Inverted Limb Systems technology uses a new type of limb tension system. Unlike prior art cantilevered limbs which are tensioned with a mid point pivot and an end tensioning block (where the limb is essentially bent over a fixed mandrel and the limb is flexed by tensioning or pulling down on the limb end), the Dual Inverted Limb Systems technology does this oppositely, in that the limb end is fixed and the mid-point pivot is the tensioning means. Also, the limb tensioning means are on the opposite side of the limb or the interior of the limb side. Allowing the limb tension to work in this manner permits the limb to move about the neutral axis when combined with the limb shape.

5—Limb Rotates About Neutral Axis

The Dual Inverted Limb Systems technology has a cantilevered limb that has an overall arc shape that folds in a near semi-circle. Inherent to this design, when the limbs move or pivot left to right, the cam position moves about the center of rotation and keeps the cam in almost the same position. This is in contrast to a cantilevered limb that will pivot about a small arc where the limb tip or cams have significant or amplified movement with a small amount of limb movement.

6—Limb Sweep and Length

The Dual Inverted Limb Systems technology allows for an extended limb length in a very compact area. The increased limb length allows the limbs (e.g., the limbs 650A, 650B) to have an extreme radius and flex over the entire length of the limb. Furthermore, the increased length can be used to allow the Dual Inverted Limb Systems technology to be used on recurve bows that naturally require increased limb movement at the limb tip without the corresponding increased size in the bow. The sweeping motion adds limb length and allows the limb to be placed near or past parallel to improve accuracy, reduce recoil, and add energy capacity to the limb.

Figure 2:
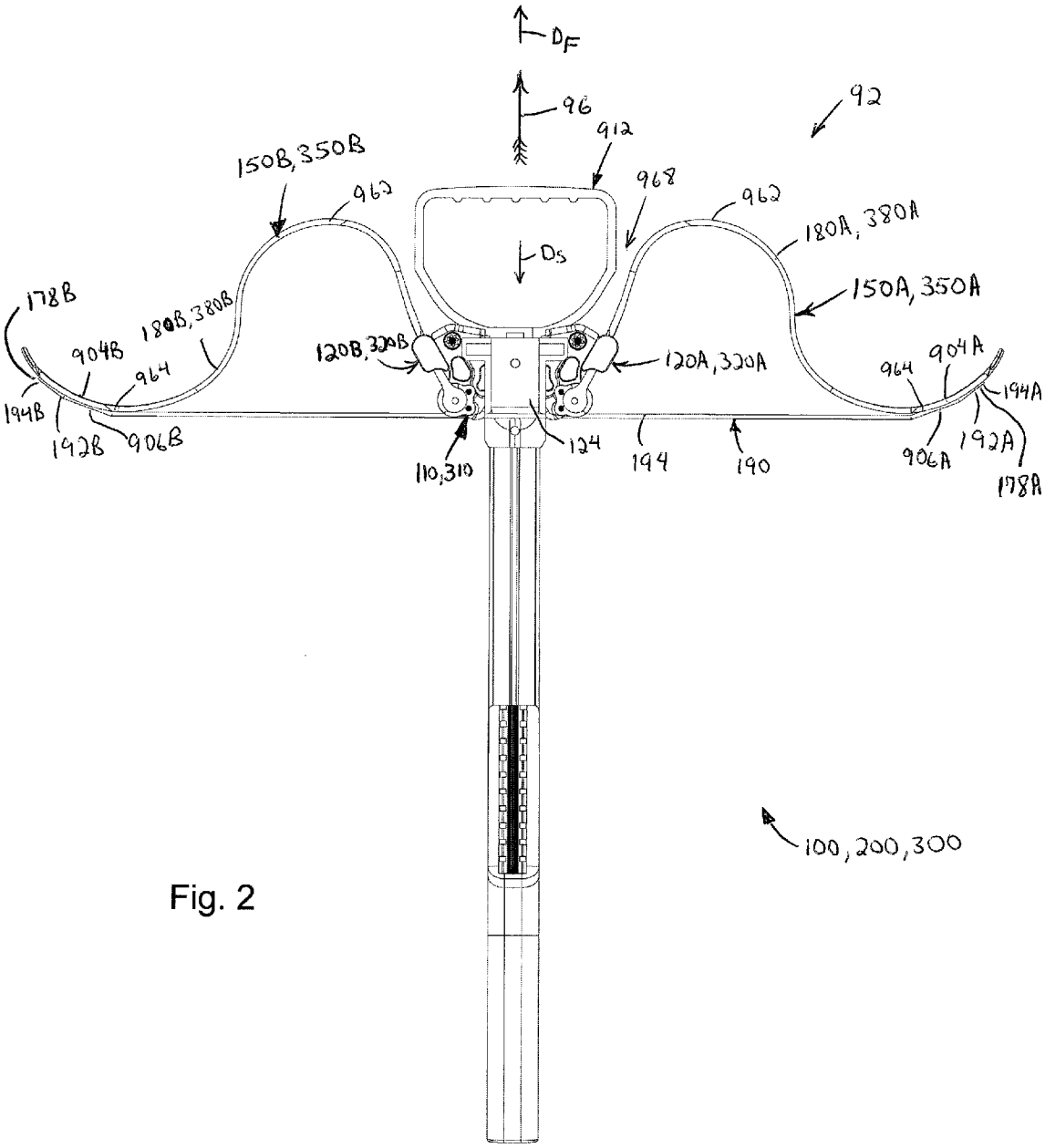
FIG. 2 is a top plan view of the bow of FIG. 1, the bow illustrated in an undrawn configuration.
Figure 3:
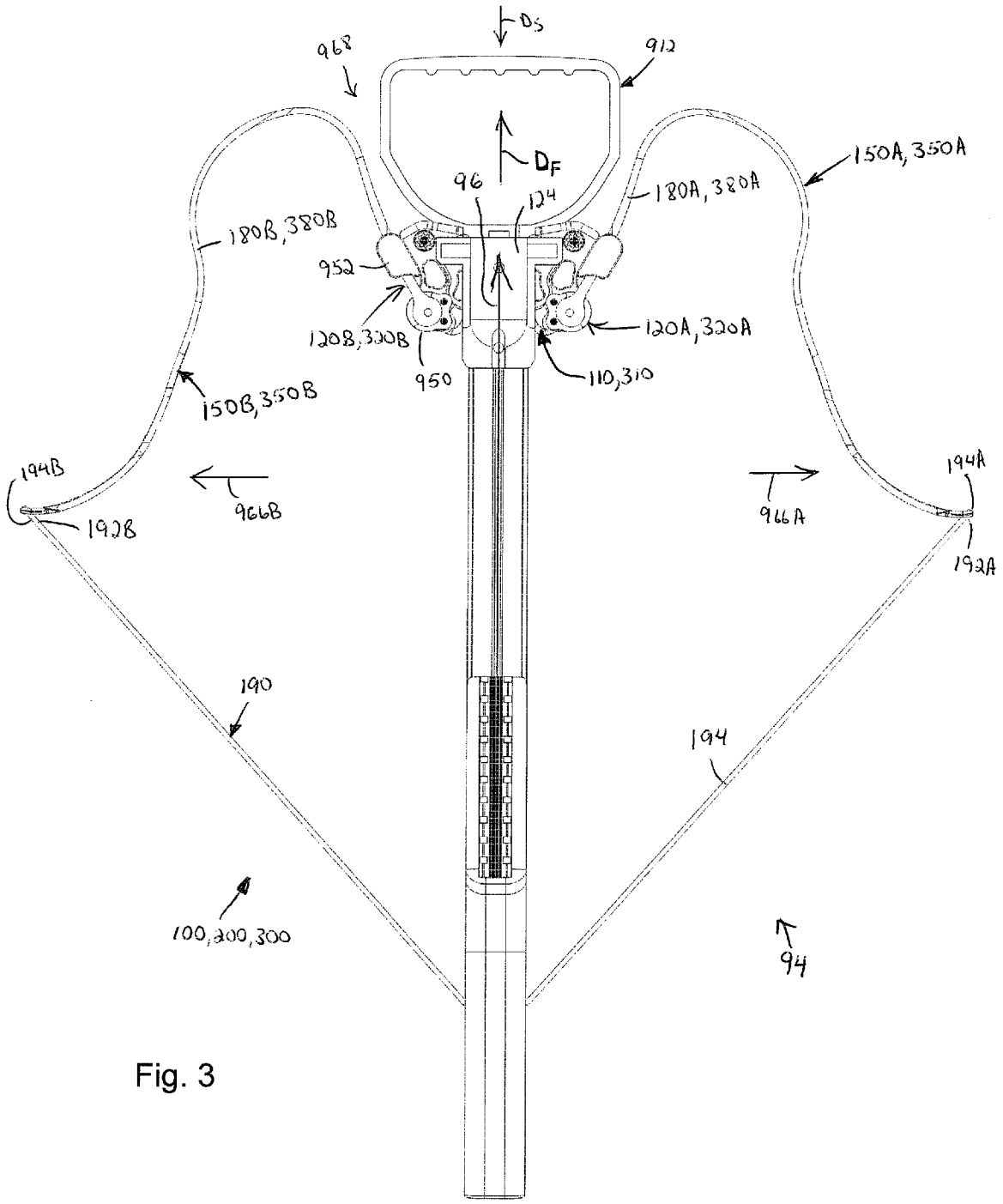
FIG. 3 is a top plan view of the bow of FIG. 1, the bow illustrated in a drawn configuration.
Figure 4:
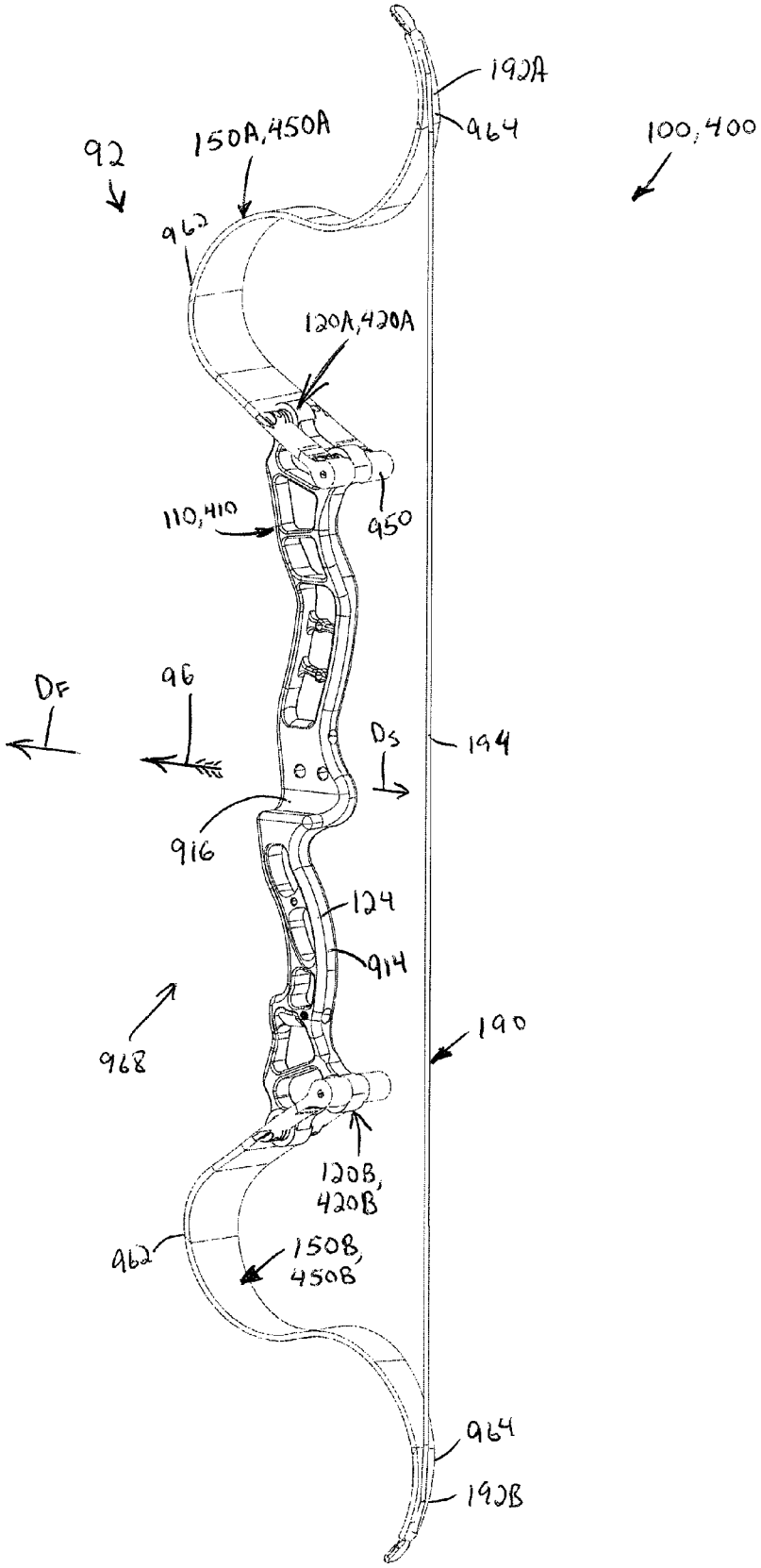
FIG. 4 is a perspective view of a bow according to the principles of the present disclosure, in particular
Figure 5:
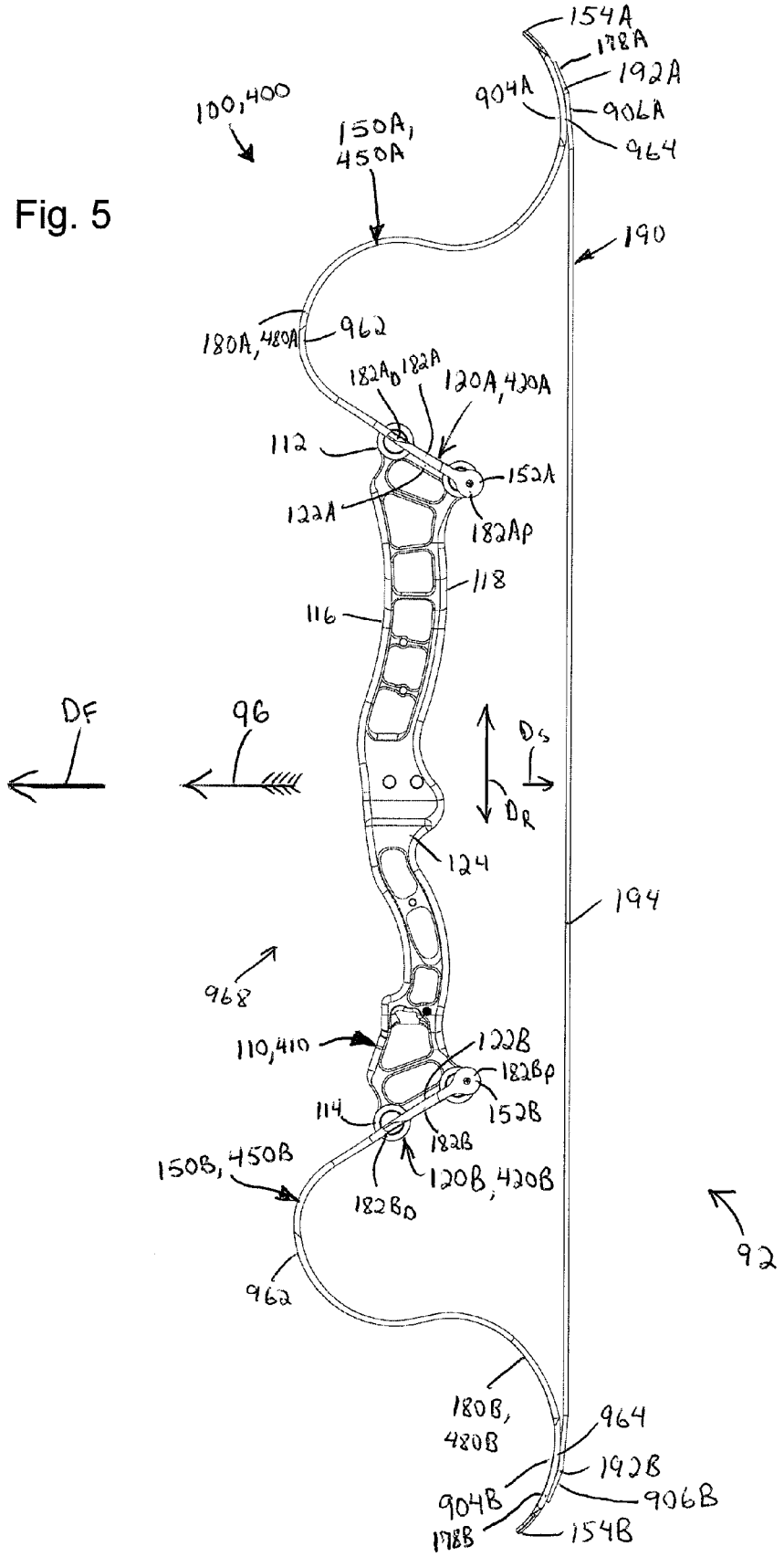
FIG. 5 is a left side elevation view of the bow of FIG. 4.
Figure 6:
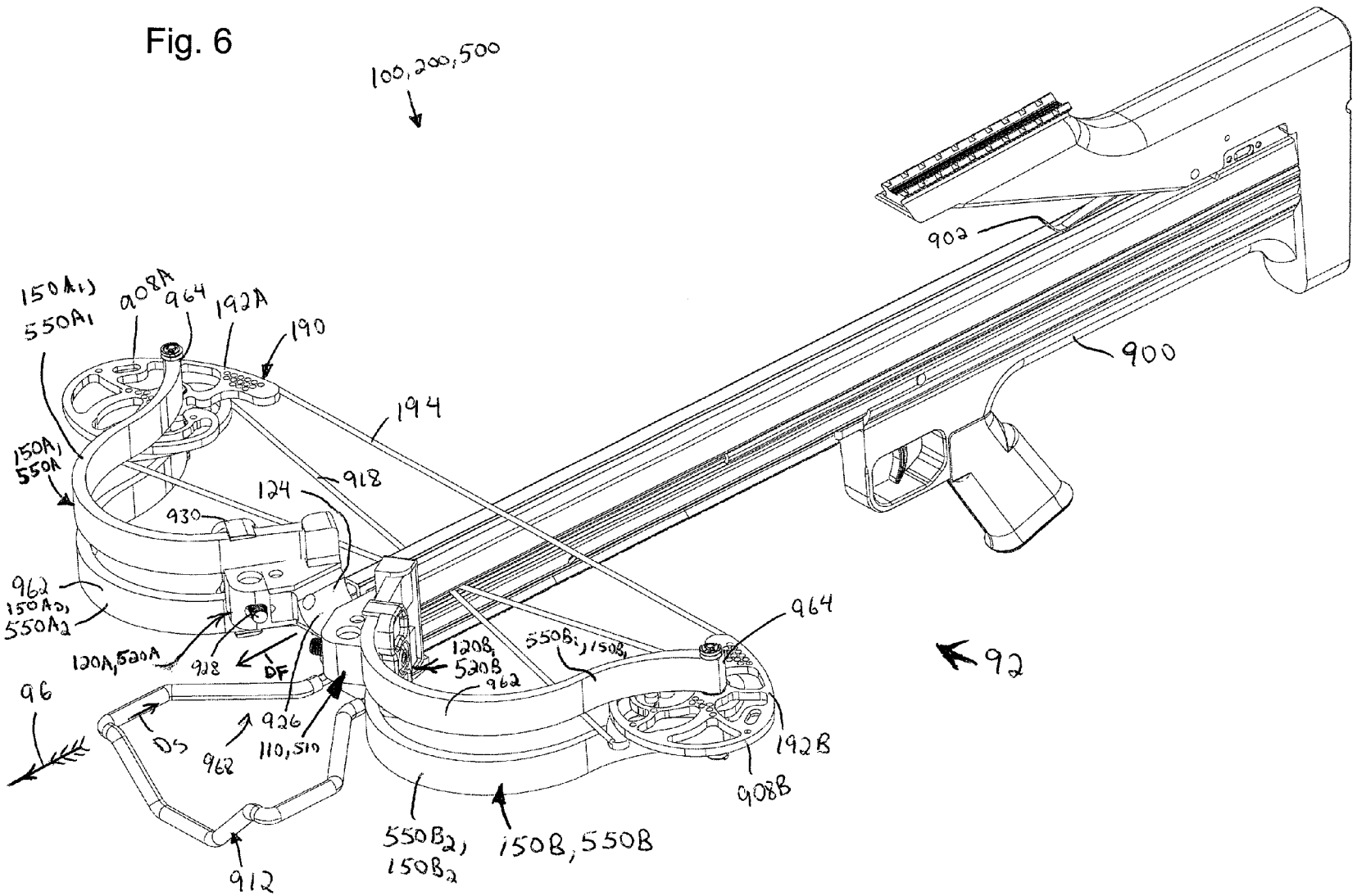
FIG. 6 is a perspective view of a bow according to the principles of the present disclosure, in particular
Figure 7:
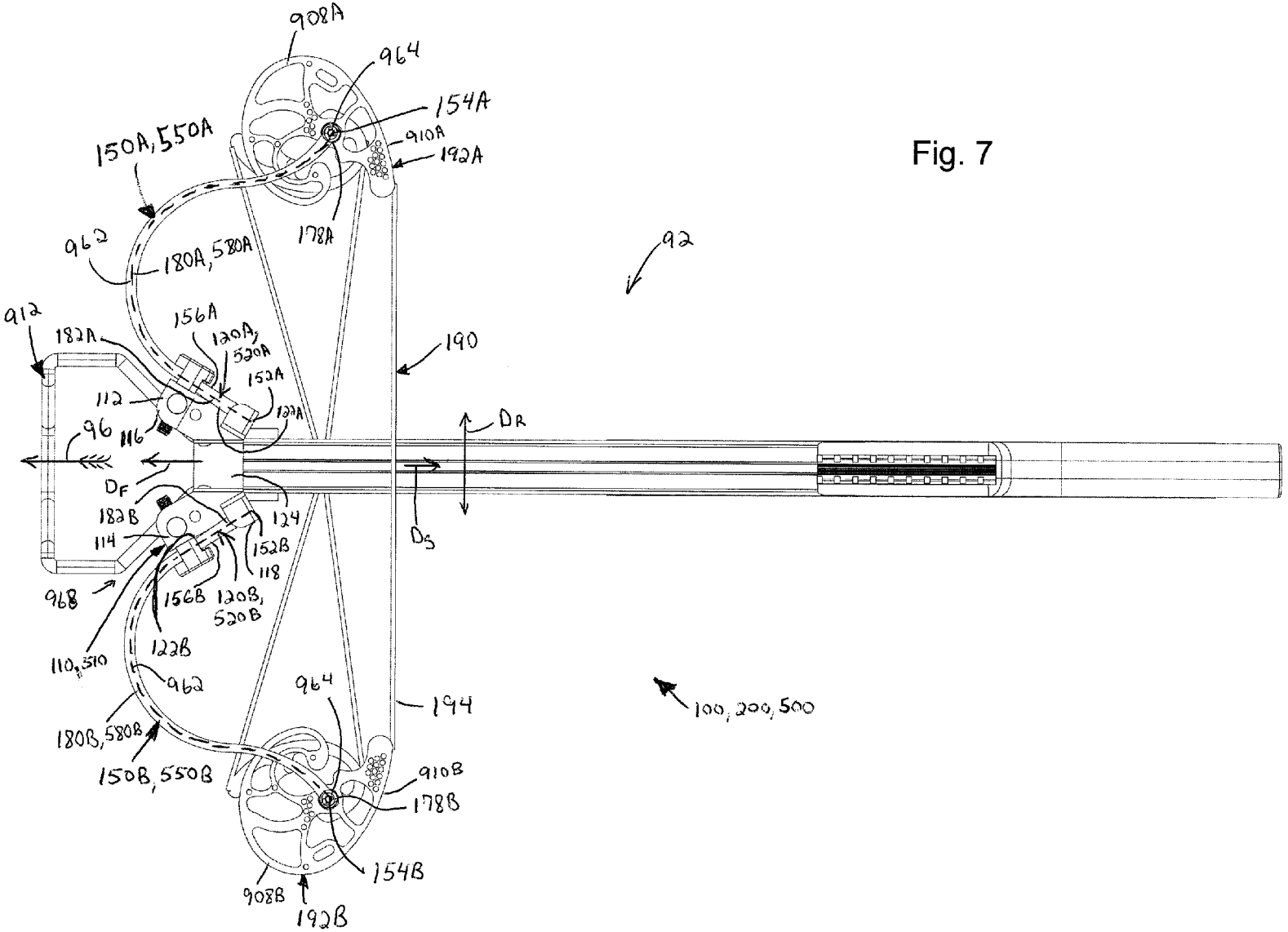
FIG. 7 is a top plan view of the bow of FIG. 6.

According to the principles of the present disclosure, a riser and bow limb configuration can be adapted for use in at least four configurations of bows 100. In particular, a recurve crossbow 300, as illustrated at FIGS. 1-3; a recurve bow 400, as illustrated at FIGS. 4 and 5; a compound crossbow 500, as illustrated at FIGS. 6 and 7; and, a compound bow 600, 800, as illustrated at FIGS. 8-11 and 13, can include the bow and limb configuration, in various embodiments, of the present disclosure. In certain embodiments, certain features of the bows 100 may be combined to create additional bows. In the figures, part reference numbers and feature reference numbers below 200 typically indicate a generic reference number that may be mixed and matched with other embodiments. Part reference numbers and feature reference numbers from 200 to 299 typically indicate and illustrate use in a crossbow 200 (e.g., the recurve crossbow 300, the compound crossbow 500, etc.). Part reference numbers and feature reference numbers from 300 to 399 typically indicate and illustrate use in the recurve crossbow 300. Part reference numbers and feature reference numbers from 400 to 499 typically indicate and illustrate use in the recurve bow 400. Part reference numbers and feature reference numbers from 500 to 599 typically indicate and illustrate use in the compound crossbow 500. Part reference numbers and feature reference numbers from 600 to 699 and from 800 to 899 typically indicate and illustrate use in the compound bow 600, 800. And, part reference numbers and feature reference numbers from 700 to 799 typically indicate and illustrate embodiments adapting components of the present disclosure into a conventional configuration.

Turning now to FIGS. 1-3, the bow 300 is illustrated according to the principles of the present disclosure. As illustrated, the bow 300 is a recurve crossbow. In addition, the bow 300 is a crossbow, in a generic sense. Furthermore, the bow 300 is a bow, in a generic sense. The bow 300 includes a riser 310 that is adapted for use with crossbows and recurve crossbows. For example, a riser cutout 926 is provided for an arrow 96 and fletching. The riser 310 also includes certain features and characteristics of a generic riser 110, further described below. The riser 310 includes a first mounting arrangement 320A and an opposite second mounting arrangement 320B that are adapted for use with crossbows and recurve crossbows. The mounting arrangements 320A, 320B also include certain features and characteristics of generic mounting arrangements 120A, 120B, further described below. The bow 300 includes a first limb 350A and a second limb 350B that are adapted for use with crossbows and recurve crossbows. The limbs 350A, 350B also include certain features and characteristics of generic limbs 150A, 150B, further described below. The limbs 350A and 350B include a first contour 380A and a second contour 380B, respectively. The contours 380A, 380B include certain characteristics of generic contours 180A, 180B, further described below.

Turning now to FIGS. 4 and 5, the bow 400 is illustrated according to the principles of the present disclosure. As illustrated, the bow 400 is a recurve bow. In addition, the bow 400 is a bow, in a generic sense. The bow 400 includes a riser 410 that is adapted for use with bows and recurve bows. For example, a handle/grip 914 is provided for the shooter and an arrow rest mount 916 is provided for an arrow rest. The riser 410 also includes certain features and characteristics of the generic riser 110. The riser 410 includes a first mounting arrangement 420A and an opposite second mounting arrangement 420B that are adapted for use with bows and recurve bows. The mounting arrangements 420A, 420B also include certain features and characteristics of the generic mounting arrangements 120A, 120B. The bow 400 includes a first limb 450A and a second limb 450B that are adapted for use with bows and recurve bows. The limbs 450A, 450B also include certain features and characteristics of the generic limbs 150A, 150B. The limbs 450A and 450B include a first contour 480A and a second contour 480B, respectively. The contours 480A, 480B include certain characteristics of the generic contours 180A, 180B.

Turning now to FIGS. 6 and 7, the bow 500 is illustrated according to the principles of the present disclosure. As illustrated, the bow 500 is a compound crossbow. In addition, the bow 500 is a crossbow, in a generic sense. Furthermore, the bow 500 is a bow, in a generic sense. The bow 500 includes a riser 510 that is adapted for use with crossbows and compound crossbows. For example, the riser cutout 926 is provided for the arrow 96 and fletching. The riser 510 also includes certain features and characteristics of the generic riser 110. The riser 510 includes a first mounting arrangement 520A and an opposite second mounting arrangement 520B that are adapted for use with crossbows and compound crossbows. The mounting arrangements 520A, 520B also include certain features and characteristics of the generic mounting arrangements 120A, 120B. The bow 500 includes a first limb 550A and a second limb 550B that are adapted for use with crossbows and compound crossbows. The limbs 550A, 550B also include certain features and characteristics of the generic limbs 150A, 150B. The limb 550A includes a pair of structural members 550$A_1$, 550$A_2$, and the limb 550B includes a pair of structural members 550$B_1$, 550$B_2$. The structural members 550$A_1$, 550$A_2$, 550$B_1$, 550$B_2$ also include certain features and characteristics of generic structural members 150$A_1$, 150$A_2$, 150$B_1$, 150$B_2$. The limbs 550A and 550B include a first contour 580A and a second contour 580B, respectively. The contours 580A, 580B include certain characteristics of the generic contours 180A, 180B. The bow 500 may further include cross over cables 918.

Figure 8:
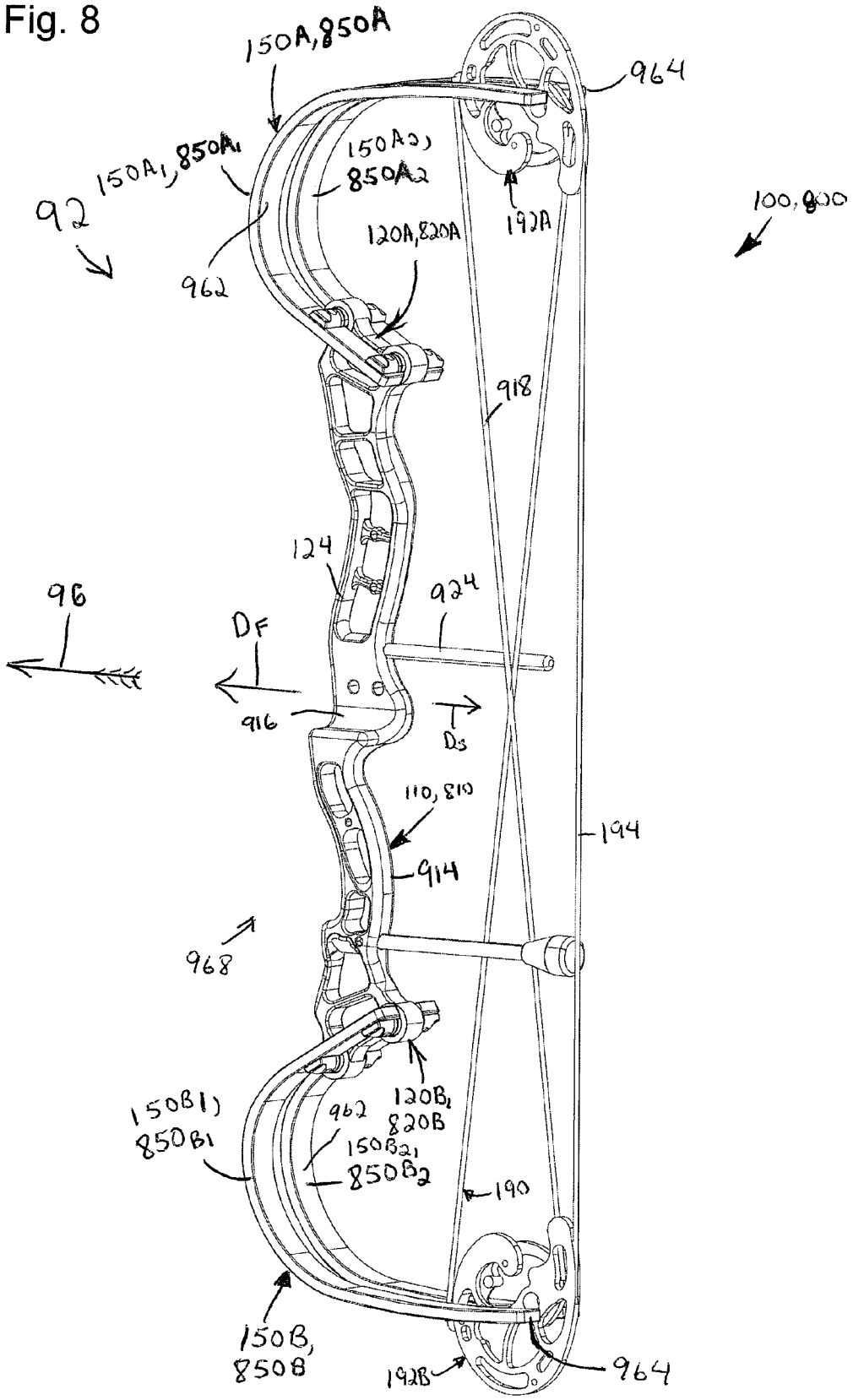
FIG. 8 is a perspective view of a bow according to the principles of the present disclosure, in particular
Figure 9:
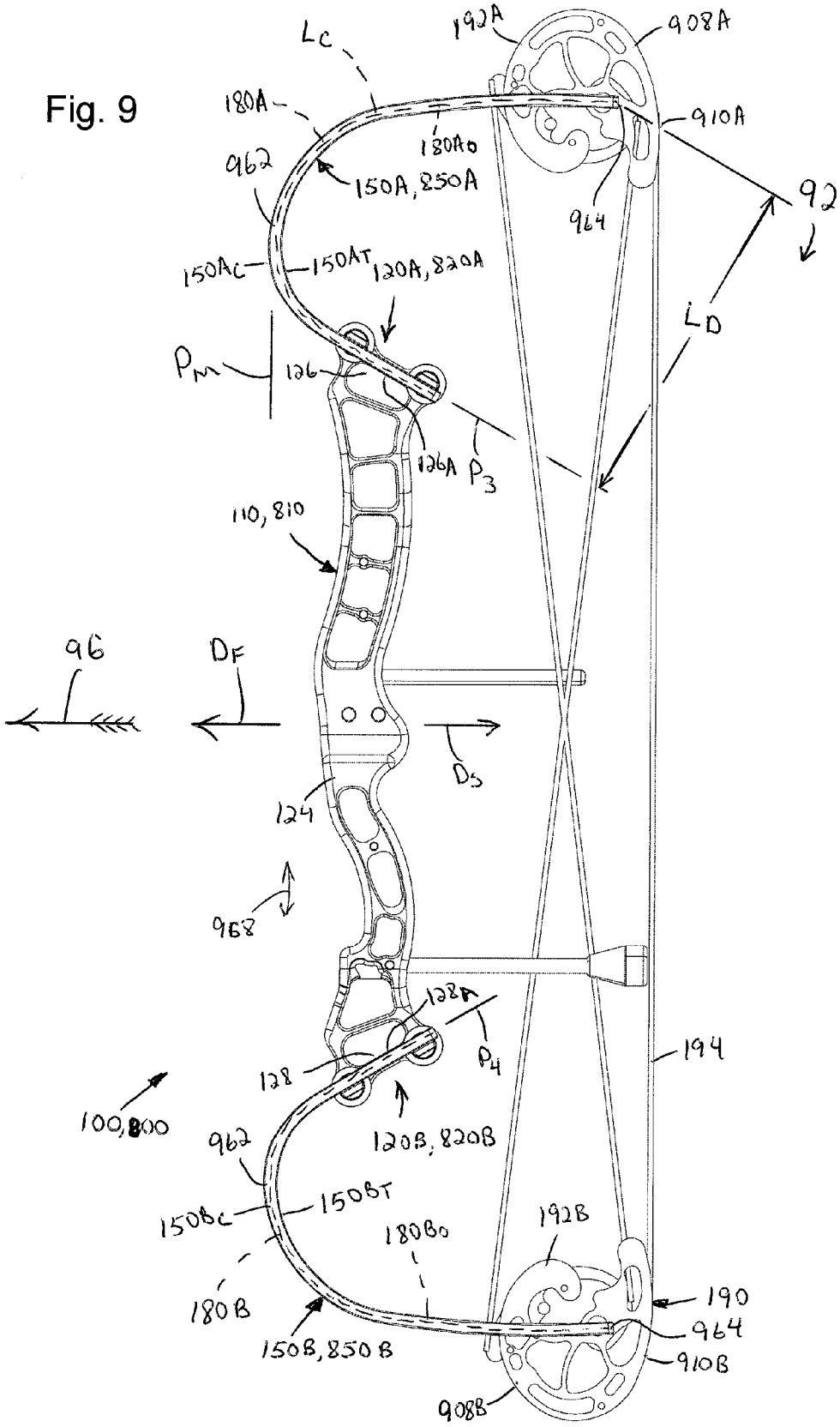
FIG. 9 is a left side elevation view of the bow of FIG. 8.
Figure 13:
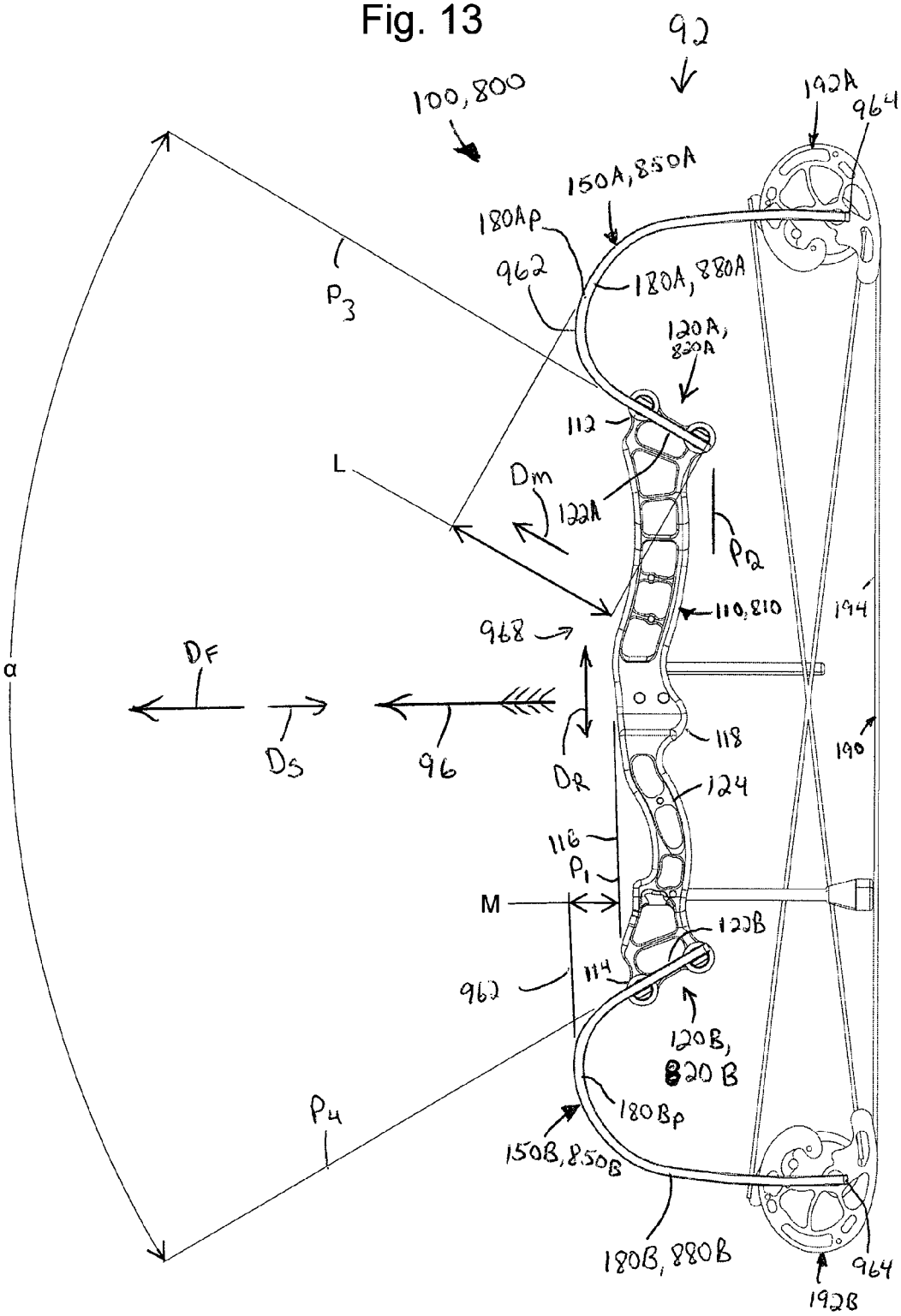
FIG. 13 is a left side elevation view of the bow of FIG. 8.

Turning now to FIGS. 8, 9, and 13, the bow 800 is illustrated according to the principles of the present disclosure. As illustrated, the bow 800 is a compound bow. In addition, the bow 800 is a bow, in a generic sense. The bow 800 includes a riser 810 that is adapted for use with bows and compound bows. For example, a handle/grip 914 is provided for the shooter and an arrow rest mount 916 is provided for an arrow rest. The riser 810 also includes certain features and characteristics of the generic riser 110. The riser 810 includes a first mounting arrangement 820A and an opposite second mounting arrangement 820B that are adapted for use with bows and compound bows. The mounting arrangements 820A, 820B also include certain features and characteristics of the generic mounting arrangements 120A, 120B. The bow 800 includes a first limb 850A and a second limb 850B that are adapted for use with bows and compound bows. The limbs 850A, 850B also include certain features and characteristics of the generic limbs 150A, 150B. The limb 850A includes a pair of structural members 850$A_1$, 850$A_2$, and the limb 850B includes a pair of structural members 850$B_1$, 850$B_2$. The structural members 850$A_1$, 850$A_2$, 850$B_1$, 850$B_2$ also include certain features and characteristics of the generic structural members 150$A_1$, 150$A_2$, 150$B_1$, 150$B_2$. The limbs 850A and 850B include a first contour 880A and a second contour 880B, respectively. The contours 880A, 880B include certain characteristics of the generic contours 180A, 180B. The bow 800 may further include cross over cables 918 and a crossover guide 924.

Turning now to FIGS. 10 and 11, the bow 600 is illustrated according to the principles of the present disclosure. As illustrated, the bow 600 is a compound bow. In addition, the bow 600 is a bow, in a generic sense. The bow 600 includes a riser 610 that is adapted for use with bows and compound bows. For example, a handle/grip 914 is provided for the shooter and an arrow rest mount 916 is provided for an arrow rest. The riser 610 also includes certain features and characteristics of the generic riser 610. The riser 610 includes a first mounting arrangement 620A and an opposite second mounting arrangement 620B that are adapted for use with bows and compound bows. The mounting arrangements 620A, 620B also include certain features and characteristics of the generic mounting arrangements 120A, 120B. The bow 600 includes a first limb 650A and a second limb 650B that are adapted for use with bows and compound bows. The limbs 650A, 650B also include certain features and characteristics of the generic limbs 150A, 150B. The limbs 650A and 650B include a first contour 680A and a second contour 680B, respectively. The contours 680A, 680B include certain characteristics of the generic contours 180A, 180B. The bow 600 may further include cross over cables 918 and a crossover guide 924.

Hereinafter, the generic bow 100 will be referred to and will further apply to bows 200, 300, 400, 500, 600, and 800, where applicable. The bow 100 is adapted to shoot the projectile 96 along a direction of flight $D_F$. A shooter may use the bow 100 to shoot the projectile 96 at various targets. Typically, the projectile 96 is an arrow. The shooter may use the bow 100 to shoot the arrow 96 at targets such as practice targets and/or at wild game. By shooting the projectile 96 from the bow 100, the shooter may hit the target with the projectile 96 traveling at sufficient speed and with sufficient energy to bring down the target.

The shooter typically stores energy in the bow 100 by drawing a drawstring arrangement 190 from an undrawn configuration 92 (see FIGS. 1, 2, 4-9, 11-13) to a drawn configuration 94 (see FIGS. 3 and 10). By drawing the drawstring arrangement 190, the shooter deforms the first limb 150A and the second limb 150B and thereby stores energy in the first and the second limbs 150A, 150B. Upon releasing the drawstring arrangement 190, the energy stored in the first and the second limbs 150A, 150B is released and delivered to the projectile 96. The projectile 96 thereby accelerates along the direction of flight $D_F$ and is thereby launched from the bow 100. Upon releasing the energy, the bow 100 returns to the undrawn configuration 92.

The drawstring arrangement 190 includes a first connection arrangement 192A that is connected to a first string mounting arrangement 178A of the first limb 150A and a second connection arrangement 192B that is connected to a second string mounting arrangement 178B of the second limb 150B. The connection arrangements 192A, 192B and the string mounting arrangements 178A, 178B may include any known components, techniques, configurations that join a drawstring to a limb.

In the recurve crossbow 300 and the recurve bow 400, the drawstring arrangement 190 includes the drawstring 194, and the drawstring 194 includes the first and the second connection arrangements 192A, 192B (e.g., a knot) at opposite ends 194A, 194B of the drawstring 194. The first limb 150A includes a first string engaging portion 904A (see FIGS. 2 and 5) that is adjacent the first string mounting arrangement 178A. The first string engaging portion 904A engages a first portion 906A of the drawstring 194 adjacent the first connection arrangement 192A when the bow 300 is in the undrawn configuration 92. The second limb 150B includes a second string engaging portion 904B that is adjacent the second string mounting arrangement 178B. The second string engaging portion 904B engages a second portion 906B of the drawstring 194 adjacent the second connection arrangement 192B when the bow 300 is in the undrawn configuration 92.

In the compound crossbow 500 and the compound bows 600 and 800, the drawstring arrangement 190 includes the drawstring 194, a first cam 908A, and a second cam 908B (see FIGS. 6, 7, 9, and 10). The first connection arrangement 192A includes the first cam 908A that is rotatably connected to the first string mounting arrangement 178A. The second connection arrangement 192B includes the second cam 908B that is rotatably connected to the second string mounting arrangement 178B. The first cam 908A engages a first portion 910A of the drawstring 194, and the second cam 908B engages a second portion 910B of the drawstring 194.

In the bows 200, 300, and 500, the drawstring arrangement 190 may be released by the shooter pulling a trigger 920 (see FIG. 1) and thereby causing a string latch 902 to release the drawstring arrangement 190. Prior to pulling the trigger 920, the shooter may use a site 922 and thereby improve accuracy of the projectile 96. The shooter may hold the bow 100 by a stock 900.

The shooter may hold the bows 400, 600, and 800 by the handle 914 (i.e., the grip). The shooter may draw the drawstring 194 of the drawstring arrangement 190 with his/her fingers and thereby deliver energy to the first and the second limbs 150A, 150B. By releasing the drawstring 194, the drawstring 194 propels the projectile 96 along the direction of flight $D_F$.

According to the principles of the present disclosure, the riser 110 and the limbs 150A, 150B include unique and beneficial relationships with each other. The first limb 150A is connected to the second limb 150B by the riser 110.

The riser 110 includes the first mounting arrangement 120A and the opposite second mounting arrangement 120B. The riser 110 extends between a first end 112 and a second end 114. The riser 110 generally extends between the first end 112 and the second end 114 in a direction $D_R$. The direction $D_R$ is generally perpendicular to the direction of flight $D_F$. The bows 200, 300, and 500 typically orient the riser 110 with the direction $D_R$ extending generally horizontally. The bows 400, 600, and 800, typically have the riser 110 oriented with the direction $D_R$ extending in a vertical direction. The riser 110 includes a first side 116 and a second side 118. The first and the second sides 116, 118 generally extend between the first and the second ends 112, 114 of the riser 110. The first side 116 is generally spaced from the second side 118 along the direction of flight $D_F$. The first side 116 of the riser 110 may generally define a first plane $P_1$. The second side 118 of the riser 110 may generally define a second plane $P_2$.

The first mounting arrangement 120A may include a first mount 122A adjacent the first end 112 of the riser 110. In certain embodiments, the first mount 122A adjoins the first end 112 of the riser 110. As illustrated at FIGS. 9 and 13, the first mount 122A may define a first mounting plane $P_3$. The second mounting arrangement 120B may include a second mount 122B. The second mount 122B may be adjacent to the second end 114 of the riser 110. In certain embodiments, the second mount 122B adjoins the second end 114 of the riser 110. The second mount 122B may define a second mounting plane $P_4$. As illustrated at FIGS. 9 and 13, the first mount 122A and the second mount 122B angle outwardly away from each other and away from the direction of flight $D_F$. In the depicted embodiment, the first mounting plane $P_3$ and the second mounting plane $P_4$ angle outwardly away from each other and away from the direction of flight $D_F$.

An included angle $\alpha$ may be defined between the first mount 122A and the second mount 122B and/or may be defined between the first mounting plane $P_3$ and the second mounting plane $P_4$. In certain embodiments, the included angle $\alpha$ may range from about 0° to about 160°. In other embodiments, the included angle $\alpha$ may range from about 15° to about 145°. In still other embodiments, the included angle $\alpha$ may range from about 30° to about 130°. In still other embodiments, the included angle $\alpha$ may range from about 45° to about 75°. In yet other embodiments, the included angle $\alpha$ may range from about 55° to about 65°. The nominal value of the included angle $\alpha$ may be 60°, as illustrated. As illustrated, the included angle α opens in the direction of flight $D_F$. In certain embodiments, the included angle α may form a vertex positioned on the bow 100 (see FIG. 2). In other embodiments, the included angle α may form a vertex that is positioned opposite the direction of flight $D_F$ (i.e., in a direction $D_S$ of the shooter) in relation to the riser 110 (see FIG. 13).

The first limb 150A may include a first attachment arrangement 156A. The first attachment arrangement 156A may be mounted to the first mounting arrangement 120A of the riser 110. In particular, the first limb 150A may be attached to the first mount 122A adjacent the proximal end 152A. In certain embodiments, the proximal end 152A may be adjacent the first mount 122A. In other embodiments, the proximal end 152A may adjoin the first mount 122A. By holding the first limb 150A, the first mounting arrangement 120A may angle the held portion of the first limb 150A about the first mounting plane $P_3$. The second limb 150B may include a second attachment arrangement 156B. The second attachment arrangement 156B may be mounted to the second mounting arrangement 120B of the riser 110. In particular, the second limb 150B may be attached to the second mount 122B adjacent the proximal end 152B. In certain embodiments, the proximal end 152B may be adjacent the second mount 122B. In other embodiments, the proximal end 152B may adjoin the second mount 122B. By holding the second limb 150B, the second mounting arrangement 120B may angle the held portion of the second limb 150B about the second mounting plane $P_4$.

The first limb 150A extends from the proximal end 152A to the distal end 154A. The first limb 150A may extend along the first contour 180A. The first contour 180A may include a first attachment segment 182A. The first attachment segment 182A may extend along the first limb 150A running adjacent to the first attachment arrangement 120A. The second limb 150B extends from the proximal end 152B to the distal end 154B. The second limb 150B may extend along the second contour 180B. The second contour 180B may include a second attachment segment 182B. The second attachment segment 182B may extend along the second limb 150B running adjacent to the second attachment arrangement 120B.

The first limb 150A may include the first string mounting arrangement 178A. The first string mounting arrangement 178A may be positioned adjacent the distal end 154A. In certain embodiments, the first string mounting arrangement 178A adjoins the distal end 154A of the first limb 150A. The first attachment segment 182A may extend from a proximal end 182$A_P$ to a distal end 182$A_D$. The first attachment segment 182A may be substantially linear and the first limb 150A may define substantially planar mounting surfaces adjacent the first attachment segment 182A. The second limb 150B may include a second string mounting arrangement 178B. The second string mounting arrangement 178B may be positioned adjacent the distal end 154B. In certain embodiments, the second string mounting arrangement 178B adjoins the distal end 154B of the second limb 150B. The second attachment segment 182B may extend from a proximal end 182$B_P$ to a distal end 182$B_D$. The second attachment segment 182B may be substantially linear and the second limb 150B may define substantially planar mounting surfaces adjacent the second attachment segment 182B.

As the limbs 150A, 150B extend along the contours 180A, 180B, the contours 180A, 180B may define various curvatures, tangencies, inflexion points, reversals of curvature, and otherwise define a winding path. A length $L_C$ may define a length of the contours 180A and/or 180B as they extend along their path (see FIG. 9). A distance $L_D$ may define a direct distance between the proximal end 152A, 152B and the distal end 154A, 154B of the limbs 150A and/or 150B, respectively. As the contour 180A, 180B may include a winding path, the length $L_C$ may be substantially longer than the length $L_D$. In certain embodiments, the length $L_C$ may be at least one and one-half times longer than the length $L_D$. In other embodiments, the length $L_C$ may be at least two times longer than the length $L_D$. In still other embodiments, the length $L_C$ may be at least three times longer than the length $L_D$.

In certain embodiments, the limb 150A includes a single monolithic structural member. In certain embodiments, the limb 150B includes a single monolithic structural member. In other embodiments, the limbs 150A and/or 150B may include a pair of the limb members 150$A_1$ 150$A_2$ and/or 150$B_1$ 150$B_2$, respectively. The pair of the limb members 150$A_1$ 150$A_2$ and/or 150$B_1$ 150$B_2$ may straddle at least a portion of the mounting arrangements 120A and 120B, respectively. In embodiments with the single monolithic structural member, the limbs 150A, 150B may include a fork at the proximal ends 152A, 152B, respectively, and thereby straddle at least a portion of the mounting arrangement 120A, 120B. The single monolithic structural member and/or the pair of limb members 150$A_1$ 150$A_2$ and/or 150$B_1$ 150$B_2$ may taper as the limbs 150A, 150B extends along the contour 180A, 180B. The limbs 150A, 150B may taper both in thickness and/or in width, and thereby match structural loads (e.g., bending moments) placed on the limbs 150A, 150B as the limbs 150A, 150B are moved between the undrawn configuration 92 and the drawn configuration 94 and/or otherwise actuated.

The limbs 150A, 150B may be made of a composite material (e.g., a carbon fiber based composite material, a glass fiber based composite material, etc.). The limbs 150A, 150B may be molded. The limbs 150A, 150B may be laid up over a mandrel and thereby receive their shape from the mandrel. The proximal ends 152A, 152B of the limbs 150A, 150B may include a round, a hole, a pin, and/or other member that allows for rotational mounting. The mounting arrangements 120A, 120B may include a cradle, a pin, and/or a round that receives the proximal ends 152A, 152B of the corresponding limb 150A, 150B. The limbs 150A, 150B may thereby connect at the proximal ends 152A, 152B, respectively, with the mounting arrangements 120A, 120B and thereby form a rotationally free mount 950. The rotationally free mount 950 may include friction. The rotationally free mount 950 may allow the corresponding limb 150A, 150B to rotate relative to the corresponding mounting arrangement 120A, 120B and thereby substantially relieve bending moments that may otherwise be transferred from the limb 150A, 150B to the mounting arrangement 120A, 120B at the proximal end 152A, 152B or adjacent to the proximal end 152A, 152B.

The mounting arrangements 120A, 120B may further include a clamp 952 that holds (i.e., constrains) the corresponding limb 150A, 150B from rotating about the corresponding mounting arrangement 120A, 120B. In certain embodiments, the clamp 952 is adjustable and thereby allows the limb 150A, 150B to be angularly adjusted with respect to the riser 110 about the rotationally free mount 950. As illustrated at FIG. 6, the clamp 952 may include a tension plate 930 and/or a tension bolt 928. By actuating the tension bolt 928, a varying amount of load may be placed on the corresponding attachment arrangement 156A, 156B of the limb 150A, 150B. By adjusting the tension bolt 928, the angular position between the corresponding limb 150A, 150B and the riser 110 may be adjusted. The adjustment of the clamp 952 or bracket may serve several purposes. For example, the clamp 952 may be used to preload the draw string arrangement 190. The adjustment of the clamp 952 may be used to set an amount of tension in the draw string arrangement 190. The actuation of the clamp 952 may allow for quick and easy assembly and disassembly of the limb 150A, 150B from the riser 110 and thereby facilitate quick and easy assembly and/or disassembly of the bow 100. The adjustment of the clamp 952 may be used to fine tune the bow 100. The adjustment of the clamp 952 may be used to adjust the first limb 150A differently than the second limb 150B and thereby tune the bow 100.

As illustrated in the figures, various components and features of the bow 100 may have various relative positions to other components and features of the bow 100. In particular, the proximal ends 152A, 152B of the limbs 150A, 150B may each be spaced in the direction $D_S$ from the plane $P_2$ that generally bounds the second side 118 of the riser 110. Alternatively, the proximal ends 152A, 152B may each be positioned along the plane $P_2$, or the proximal ends 152A, 152B may each be positioned between the first plane $P_1$ that generally bounds the first side 116 of the riser 110 and the second plane $P_2$ of the riser 110. The distal ends 154A, 154B of the limbs 150A, 150B may each be spaced from the plane $P_2$ in the direction $D_S$. Alternatively, the distal ends 154A, 154B may each be positioned along the plane $P_2$ when the bow 100 is in the undrawn configuration 92. Alternatively, the distal ends 154A, 154B may each be positioned between the first plane $P_1$ and the second plane $P_2$ when the bow 100 is in the undrawn configuration 92. Alternatively, the distal ends 154A, 154B may each be spaced from the plane $P_1$ in the direction of flight $D_F$ when the bow 100 is in the undrawn configuration 92. Alternatively, the distal ends 154A, 154B may each be spaced from the plane $P_2$ in the direction $D_S$ when the bow is in the drawn configuration 94.

As illustrated in the figures, the interface geometry between the limbs 150A, 150B and the riser 110 may vary in various embodiments. In particular, at least opposite portions of the first and the second attachment segments 182A, 182B may be angled relative to each other such that the opposite portions of the attachment segments 182A, 182B extend outwardly away from each other as the attachment segments 182A, 182B at least partially extend in the direction of flight $D_F$. In certain embodiments, at least a portion of each of the first and the second attachment segments 182A, 182B are substantially linear. In certain embodiments, the first and the second attachment segments 182A, 182B are substantially parallel to each other, at least about the substantially linear portions. In other embodiments, the first and the second attachment segments 182A, 182B are angled relative to each other, at least about the substantially linear portions. In certain embodiments, the first and the second attachment segments 182A, 182B are angled relative to each other, at least about the substantially linear portions, such that the first and the second attachment segments 182A, 182B extend outwardly away from each other as the attachment segments 182A, 182B partially extend in the direction of flight $D_F$. In other embodiments, the first and the second attachment segments 182A, 182B may continuously curve, and the included angle $\alpha$ may be defined between positions on opposite curves.

As illustrated at FIGS. 1 and 10, the riser 110 spaces the proximal ends 152A, 152B of the limbs 150A, 150B apart from each other a distance $D_L$. In the depicted embodiments, the proximal ends 152A, 152B of the limbs 150A, 150B are spaced apart in the direction $D_R$. The distance $D_L$ may vary depending on the configuration of the bow 100, the configuration of the limbs 150A, 150B, and/or the configuration of the riser 110. In certain embodiments, the distance $D_L$ may be zero and the proximal ends 152A, 152B of the limbs 150A, 150B may therefore adjoin each other. In certain embodiments, the proximal ends 152A, 152B of the limbs 150A, 150B may be structurally connected directly to each other.

As illustrated in the figures, the first contour 180A and the second contour 180B may have unique and beneficial shapes. In particular, as illustrated at FIG. 13, the contours 180A, 180B may each include a protruding segment 180$A_P$, 180$B_P$, respectively, that follows the corresponding attachment segment 182A, 182B. The protruding segments 180$A_P$, 180$B_P$ may each extend beyond the first plane $P_1$. A proximal end of each of the protruding segments 180$A_P$, 180$B_P$ may adjoin the distal end of the corresponding attachment segment 182A, 182B. As illustrated at FIG. 13, in certain embodiments, each of the protruding segments 180$A_P$, 180$B_P$ may extend a distance M of at least 2 inches in the direction of flight $D_F$ beyond the plane $P_1$. In certain embodiments, each of the protruding segments 180$A_P$, 180$B_P$ may extend a distance M of at least 1 inch in the direction of flight $D_F$ beyond the plane $P_1$. The protruding segments 180$A_P$, 180$B_P$ may follow the corresponding attachment segment 182A, 182B. In certain embodiments, each of the protruding segments 180$A_P$, 180$B_P$ may extend a distance L of at least 1 inch from the proximal end 152A, 152B of the corresponding limb 150A, 150B in a direction $D_M$ parallel to the substantially linear portion of the corresponding attachment segment 182A, 182B. In certain embodiments, the distance L may be at least 2 inches. In certain embodiments, the distance L may be at least 5 inches. In certain embodiments, the distance L may range between 2 inches and about 10 inches. In certain embodiments, the distance L may range between 1 inch and about 10 inches. In certain embodiments, the protruding segments 180$A_P$, 180$B_P$ curve inwardly toward each other adjacent the proximal ends of the protruding segments 180$A_P$, 180$B_P$. In certain embodiments, the protruding segments 180$A_P$, 180$B_P$ curve outwardly away from each other adjacent the proximal end of the protruding segments 180$A_P$, 180$B_P$.

In certain embodiments, the protruding segments 180$A_P$ 180$B_P$ of the first and the second contours 180A, 180B each follow the corresponding attachment segment 182A, 182B. The protruding segments 180$A_P$, 180$B_P$ may each extend beyond the plane $P_1$. The proximal end of each of the protruding segments 180$A_P$, 180$B_P$ may adjoin the distal end of the corresponding attachment segment 182A, 182B. Each of the protruding segments 180$A_P$, 180$B_P$ may linearly extend adjacent the proximal end of the corresponding protruding segments 180$A_P$, 180$B_P$ in the direction $D_M$.

As illustrated at FIG. 9, in certain embodiments, the protruding segments 180$A_P$, 180$B_P$ may each reach a plane of maximum protrusion $P_M$ while curving outwardly away from each other. In certain embodiments, the protruding segments 180$A_P$, 180$B_P$ each curve tangent to the plane $P_M$ of maximum protrusion. In certain embodiments, the protruding segments 180$A_P$, 180$B_P$ reach the plane $P_M$ of maximum protrusion and curve toward the plane $P_1$. In certain embodiments, the protruding segments 180$A_P$, 180$B_P$ may each reach a distal end of the corresponding protruding segment 180$A_P$, 180$B_P$ upon the first and the second contours 180A, 180B reaching the first plane $P_1$, and the distal ends of the protruding segments 180$A_P$, 180$B_P$ are spaced farther from each other than the proximal ends of the protruding segments 180$A_P$, 180$B_P$ are spaced from each other. In certain embodiments, the first and the second contours 180A, 180B each continue from the distal end of the corresponding protruding segment 180$A_P$, 180$B_P$ to the distal end of the corresponding limb 150A, 150B.

As illustrated at FIG. 13, the corresponding contours 180A, 180B of the first and the second limbs 150A, 150B may each extend from the proximal end at least partially in the direction of flight $D_F$ to a farthest forward position 962 beyond the riser 110 along the direction of flight $D_F$ and then reverse and extend at least partially in the direction $D_S$ to a farthest rearward position 964.

As illustrated at FIGS. 1-3, 6, and 7, the first contour 180A and the second contour 180B of the limbs 150A and 150B, respectively, form a recess 968 between the protruding segments 180$A_P$, 180$B_P$. A foot stirrup 912 may be advantageously positioned within the recess 968.

As illustrated at FIG. 9, in certain embodiments, the first and the second contours 180A, 180B include opposing segments 180$A_O$ 180$B_O$ that move opposite each other when the projectile 96 is shot and thereby at least partially cancel recoil.

According to the principles of the present disclosure, the bow 100 includes a unique and beneficial mounting arrangement between the riser 110 and the limbs 150A, 150B. In particular, as illustrated at FIGS. 9 and 10, the riser 110 includes a main body 124 that extends between a first end 126 and a second end 128. The main body 124 includes a first mounting area 126$_A$ that is adjacent the first end 126 and a second mounting area 128$_A$ that is adjacent the second end 128. The first limb 150A includes a tensilely stressed side 150$A_T$ and a compressively stressed side 150$A_C$. The first limb 150A is mounted to the riser 110 with the tensilely stressed side 150$A_T$ facing the first mounting area 126$_A$ of the main body 124 of the riser 110. The second limb 150B includes a tensilely stressed side 150$B_T$ and a compressively stressed side 150$B_C$. The second limb 150B is mounted to the riser 110 with the tensilely stressed side 150$B_T$ facing the second mounting area 128$_A$ of the main body 124 of the riser 110. The tensilely stressed sides 150$A_T$, 150$B_T$ of the first and the second limbs 150A, 150B may at least partially face each other. The tensilely stressed sides 150$A_T$, 150$B_T$ of the first and the second limbs 150A, 150B may be positioned opposite each other.

The various embodiments described above are provided by way of illustration only and should not be construed to limit the claims attached hereto. Those skilled in the art will readily recognize various modifications and changes that may be made without following the example embodiments and applications illustrated and described herein, and without departing from the true spirit and scope of the following claims.

What is claimed is:

1. A bow adapted to shoot a projectile along a direction of flight defining a forward direction, the bow having a drawn condition and an undrawn condition, the bow comprising:

a riser including a first mounting arrangement and an opposite second mounting arrangement;

a first limb extending along a first contour from a proximal end to a distal end, the first limb including a first attachment arrangement mounted to the first mounting arrangement of the riser, the first contour including a first attachment segment extending along the first limb adjacent the first attachment arrangement, and the first limb including a first string mounting arrangement;

a second limb extending along a second contour from a proximal end to a distal end, the second limb including a second attachment arrangement mounted to the second mounting arrangement of the riser, the second contour including a second attachment segment extending along the second limb adjacent the second attachment arrangement, and the second limb including a second string mounting arrangement; and a drawstring arrangement including a first connection arrangement connected to the first string mounting arrangement and a second connection arrangement connected to the second string mounting arrangement;

wherein the first and the second attachment segments of the first and the second limbs are angled relative to the direction of flight such that the first and the second attachment segments extend outwardly away from each other as the first and the second attachment segments partially extend in the direction of flight in both the drawn condition and the undrawn condition; and wherein the proximal ends of the first and the second limbs are positioned forward of the distal ends of the first and the second limbs at least when the bow is in the drawn configuration.

2. The bow of claim 1, further comprising a stock and a string latch, wherein the bow is configured as a crossbow.

3. The bow of claim 1, wherein the drawstring arrangement further includes a drawstring, wherein the first connection arrangement includes a first cam rotatably connected to the first string mounting arrangement, wherein the second connection arrangement includes a second cam rotatably connected to the second string mounting arrangement, wherein the first cam engages a first portion of the drawstring, wherein the second cam engages a second portion of the drawstring, and wherein the bow is configured as a compound bow.

4. A bow adapted to shoot a projectile along a direction of flight defining a forward direction, the bow comprising:

a riser;

a first limb extending along a first contour from a proximal end to a distal end, the first limb attached to the riser, the first limb including a first string mounting arrangement;

a second limb extending along a second contour from a proximal end to a distal end, the second limb attached to the riser, the second limb including a second string mounting arrangement; and a drawstring arrangement including a first connection arrangement connected to the first string mounting arrangement and a second connection arrangement connected to the second string mounting arrangement;

wherein the proximal ends of the first and the second limbs are positioned forward of the distal ends of the first and the second limbs at least when the bow is in a drawn configuration; wherein the corresponding contours of the first and the second limbs each extend from the proximal end partially in the direction of flight to a farthest forward position beyond the riser along the direction of flight and then reverse and extend at least partially in an opposite direction from the direction of flight to a farthest rearward position.

5. The bow of claim 4, wherein the farthest rearward position of the corresponding contours of the first and the second limbs is beyond the riser along the opposite direction.

6. The bow of claim 4, wherein the farthest rearward position of the corresponding contours of the first and the second limbs is the distal end of the corresponding limbs.

7. The bow of claim 4, wherein the corresponding contours of the first and the second limbs continue from the farthest rearward position and again reverse and extend at least partially in the direction of flight to the distal end of the corresponding limbs.

8. The bow of claim 1, wherein the corresponding contours of the first and the second limbs are shaped such that a length of the contours between the proximal and the distal ends of the corresponding limbs is at least 1.5 times longer than a direct distance between the proximal and the distal ends.

9. The bow of claim 8, wherein the length is at least 2 times longer than the direct distance.

10. The bow of claim 8, wherein the length is at least 3 times longer than the direct distance.

11. A bow adapted to shoot a projectile along a direction of flight defining a forward direction, the bow comprising:

a riser extending between a first end and a second end in a direction generally perpendicular to the direction of flight, the riser including a first side and a second side that each extend between the first and the second ends of the riser, the first side of the riser spaced from the second side of the riser along the direction of flight, and the riser including a first mount adjacent the first end of the riser and a second mount adjacent the second end of the riser;

a first limb extending along a first contour from a proximal end to a distal end, the first limb mounted to the first mount of the riser adjacent the proximal end of the first limb, the first contour including a first attachment segment extending from the proximal end to a distal attachment segment portion, the first attachment segment positioned adjacent the first mount;

a second limb extending along a second contour from a proximal end to a distal end, the second limb mounted to the second mount of the riser adjacent the proximal end of the second limb, the second contour including a second attachment segment extending from the proximal end to a distal attachment segment portion, the second attachment segment positioned adjacent the second mount; and a drawstring operably connected to the first and the second limbs adjacent the distal ends of the first and the second limbs;

wherein the first and the second attachment segments at least partially extend in the direction of flight from the proximal end to the distal attachment segment portion of the corresponding attachment segment.

12. The bow of claim 11, wherein at least opposite portions of the first and the second attachment segments are angled relative to each other such that the opposite portions of the first and the second attachment segments extend outwardly away from each other as the first and the second attachment segments partially extend in the direction of flight.

13. The bow of claim 12, wherein an included angle in a range of about 0 degrees to about 160 degrees is defined between at least the opposite portions of the first and the second attachment segments.

14. The bow of claim 13, wherein the range of the included angle is about 30 degrees to about 130 degrees.

15. The bow of claim 13, wherein the range of the included angle is about 45 degrees to about 75 degrees.

16. The bow of claim 13, wherein the range of the included angle is about 55 degrees to about 65 degrees.

17. The bow of claim 11, wherein at least a portion of each of the first and the second attachment segments are substantially linear.

18. The bow of claim 11, wherein the first and the second contours each include a protruding segment that follows the corresponding attachment segment, the protruding segments each extending beyond a first plane generally bounding the first side of the riser.

19. The bow of claim 18, wherein each of the protruding segments extends at least 1 inch in the direction of flight beyond the first plane that generally bounds the first side of the riser.

20. The bow of claim 17, wherein the first and the second contours each include a protruding segment that follows the corresponding attachment segment and wherein each of the protruding segments extends at least 1 inch from the proximal end of the corresponding limb in a direction parallel to the substantially linear portion of the corresponding attachment segment.

21. The bow of claim 20, wherein the protruding segments extend at least 5 inches from the proximal end of the corresponding limb.

22. The bow of claim 20, wherein the protruding segments extend a range between 1 inch and about 10 inches from the proximal end of the corresponding limb.

23. The bow of claim 18, wherein a recess is formed between the protruding segments of the first and the second contours in the direction of flight from the first side of the riser.

24. The bow of claim 23, further comprising a foot stirrup, wherein the bow is a crossbow and wherein the foot stirrup is positioned within the recess.

25. A bow adapted to shoot a projectile along a direction of flight, the bow comprising:

a riser including a main body extending between a first end and a second end, the main body of the riser including a first mounting area adjacent the first end of the main body and a second mounting area adjacent the second end of the main body;

a first limb including a tensilely stressed side and a compressively stressed side, the first limb extending along a first contour from a proximal end to a distal end, the first limb mounted to the riser with the tensilely stressed side of the first limb facing the first mounting area of the main body of the riser;

a second limb including a tensilely stressed side and a compressively stressed side, the second limb extending along a second contour from a proximal end to a distal end, the second limb mounted to the riser with the tensilely stressed side of the second limb facing the second mounting area of the main body of the riser; and a drawstring operably connected to the first and the second limbs adjacent the distal ends of the first and the second limbs.

26. The bow of claim 25, wherein the tensilely stressed sides of the first and the second limbs at least partially face each other.

27. The bow of claim 25, wherein the tensilely stressed sides of the first and the second limbs are positioned opposite each other.

* * * * *